United States Patent [19]

Smith

[11] Patent Number: 4,999,976

[45] Date of Patent: Mar. 19, 1991

[54] MEANS AND METHOD FOR ULTRASONIC GASSING OF AEROSOLS

[75] Inventor: Rodney P. Smith, Moline, Ill.

[73] Assignee: The Kartridg Pak Co., Davenport, Iowa

[21] Appl. No.: 388,996

[22] Filed: Aug. 3, 1989

[51] Int. Cl.[5] ..... B65B 7/28; B65B 31/00

[52] U.S. Cl. ..... 53/470; 53/88; 141/3; 141/20; 141/64; 141/74

[58] Field of Search ..... 53/88, 97, 109, 381 A, 53/437, 470, 525; 141/51, 63, 64, 66, 74, 3, 20; 366/108

[56] References Cited

U.S. PATENT DOCUMENTS

| | | | |
|---|---|---|---|
| 2,505,439 | 4/1950 | Suellentrop | 141/64 |
| 2,584,063 | 1/1952 | Suellentrop | 141/74 X |
| 2,683,558 | 7/1954 | Suellentrop | 141/74 X |
| 2,831,666 | 4/1958 | Compton | 366/108 X |
| 3,013,591 | 12/1961 | Stanley et al. | 141/3 X |
| 3,123,104 | 3/1964 | Westen et al. | 141/64 |
| 3,152,429 | 10/1964 | Stanley et al. | 53/88 |
| 3,157,974 | 11/1964 | Stanley et al. | 53/88 |
| 3,259,152 | 7/1966 | Schimkat | 141/64 X |
| 3,614,069 | 10/1971 | Murry | 366/108 X |
| 3,745,741 | 7/1973 | Cunningham et al. | 53/88 |
| 4,086,741 | 5/1978 | Williams | 53/88 X |

*Primary Examiner*—Robert L. Spruill
*Assistant Examiner*—Linda B. Johnson
*Attorney, Agent, or Firm*—Lockwood, Alex, FitzGibbon & Cummings

[57] ABSTRACT

A supply of a propellant gas is maintained at substantially uniform temperature and pressure. Uniform predetermined increments of the propellant gas are withdrawn in rapid succession and rapidly introduced into aerosol containers in which product to be dispensed has already been introduced. Such containers are subjected to ultrasonic frequency agitation during the introduction of the propellant thereby enhancing the speed of introduction. The propellant may be introduced into a container either by the "through-the-valve" method or by the "under-the-cap" method at conventional speeds using known commercial equipment.

8 Claims, 2 Drawing Sheets

Figure 1:
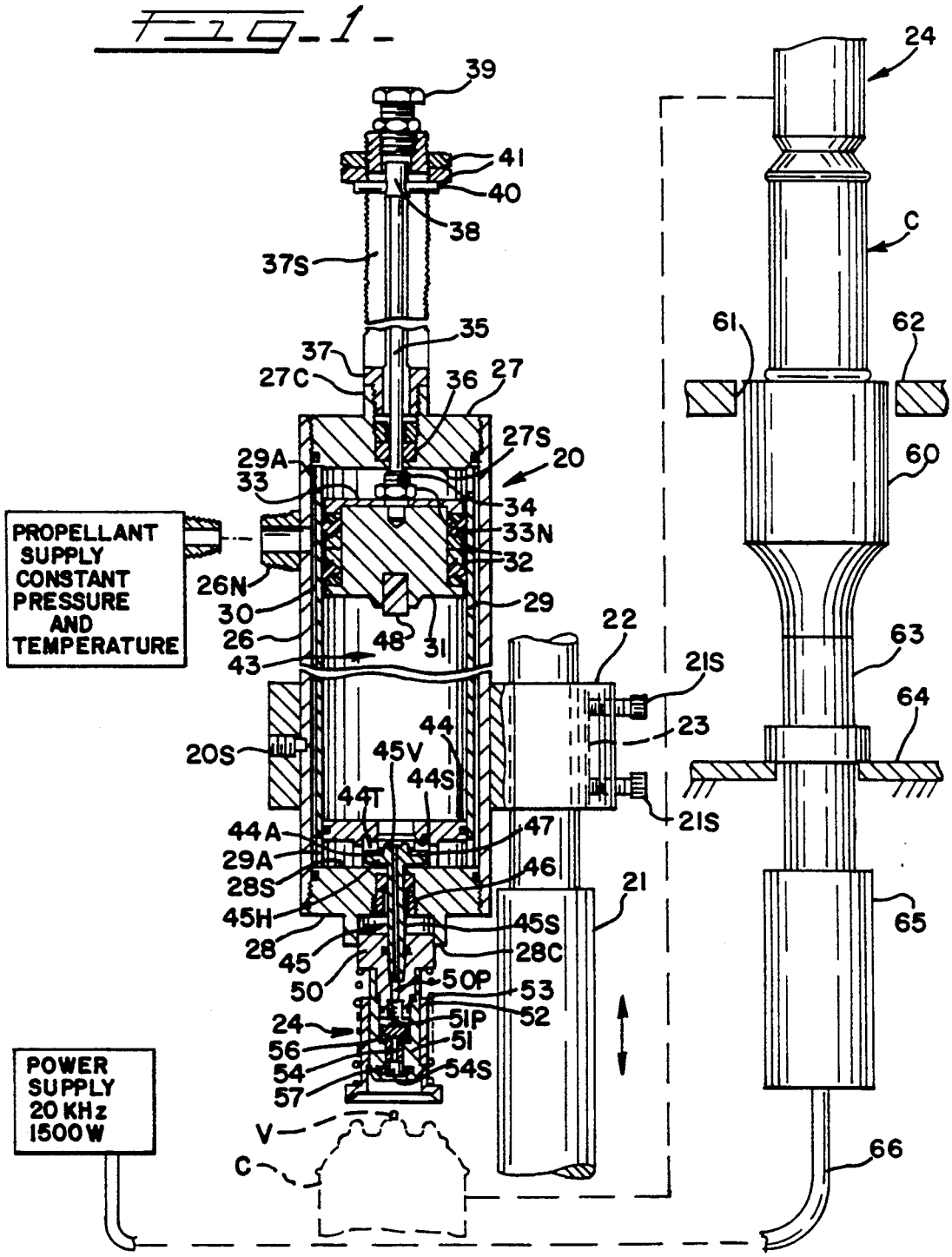

PROPELLANT SUPPLY CONSTANT PRESSURE AND TEMPERATURE
POWER SUPPLY 20 KHz 1500W
39
41
40
38
37S
35
37
27C
36
27
27S
20
29A
33
34
33N
32
26N
30
29
26
48
31
43
22
21S
23
20S
44
45V
44S
44T
21S
44A
47
29A
46
28S
21
45H
45S
28
45
28C
50
50P
53
52
24
51P
56
51
54
54S
57
V
C
24
C
61
62
60
63
64
65
66

MEANS AND METHOD FOR ULTRASONIC GASSING OF AEROSOLS

This invention relates generally to improved means and method for introducing gaseous propellants into aerosol containers into which product to be dispensed in aerosol or spray form has already been introduced. More particularly, the invention relates to the use of ultrasonic agitation of aerosol containers to facilitate high production speed, gassing or saturation of aerosol products with compressed gases such as carbon dioxide and nitrous oxide as propellants. For a variety of reasons, convenience being one of the most important, a wide variety of products have been packaged so as to be dispensed in aerosol or finely divided spray form. Insecticides were among the earliest products to be dispensed in aerosol form with propellants being liquifying halogenated fluorocarbons such as Freon 11 and 12. The physical properties of such fluorocarbons were such as to make them very useful as propellants both from the standpoint of being easily introduced into the aerosol packages or containers and from acting as efficient propellants for dispensing the various products. The fluorocarbon propellants could not be used with certain products, particularly edible products such as whipped cream, and other propellants such as nitrous oxide and carbon dioxide were used instead. However, these other propellants were more difficult to introduce and expedients such as mechanical shaking devices, were required to achieve an acceptable rate of production. After a number of years, it was perceived that the liquifying halogenated fluorocarbons which were used for many purposes in addition to use as aerosol propellants, had an untoward effect on the ionospheric ozone layer. This led to the banning in the United States of the use of halogenated fluorocarbons for most aerosol uses starting in 1976. The 1986 "Montreal Protocol" among major industrialized nations set a phase-out schedule for chlorinated fluorocarbons for all uses, including aerosols, worldwide. During the interim between 1976 and 1986, the U.S. Aerosol Industry had essentially replaced the halogenated fluorocarbon propellants with hydrocarbons, such as butane and propane. While these hydrocarbon propellants produce a satisfactory constant-pressure effect, they are flammable and also subject to regulation by the Environmental Protection Agency due to their perceived contribution to lower atmosphere air pollution.

In view of the foregoing circumstances, particularly the environmental factors as well as cost factors, there has been a need for more economical, benign aerosol propellants for general usage. According to the present invention, a method and apparatus have been provided which facilitate and make practical, high production speed gassing of aerosols with compressed gases such as carbon dioxide and nitrous oxide as propellants. The present invention is based upon the combination or bringing into play two separate techniques. One is the ultrasonic agitation of the contained liquid product to be dispensed during the gassing so as to create a cavitation effect which permits rapid saturation of the maximum amount of propellant gas into the liquid products, including difficult to saturate liquids such as water and other aqueous products. The second technique is the rapid withdrawal of predetermined volumes of the propellant gas from a supply thereof maintained at a substantially uniform pressure and temperature followed by the rapid introduction of the predetermined volume into the liquid product while it is being subjected to ultrasonic agitation.

Figure 2:
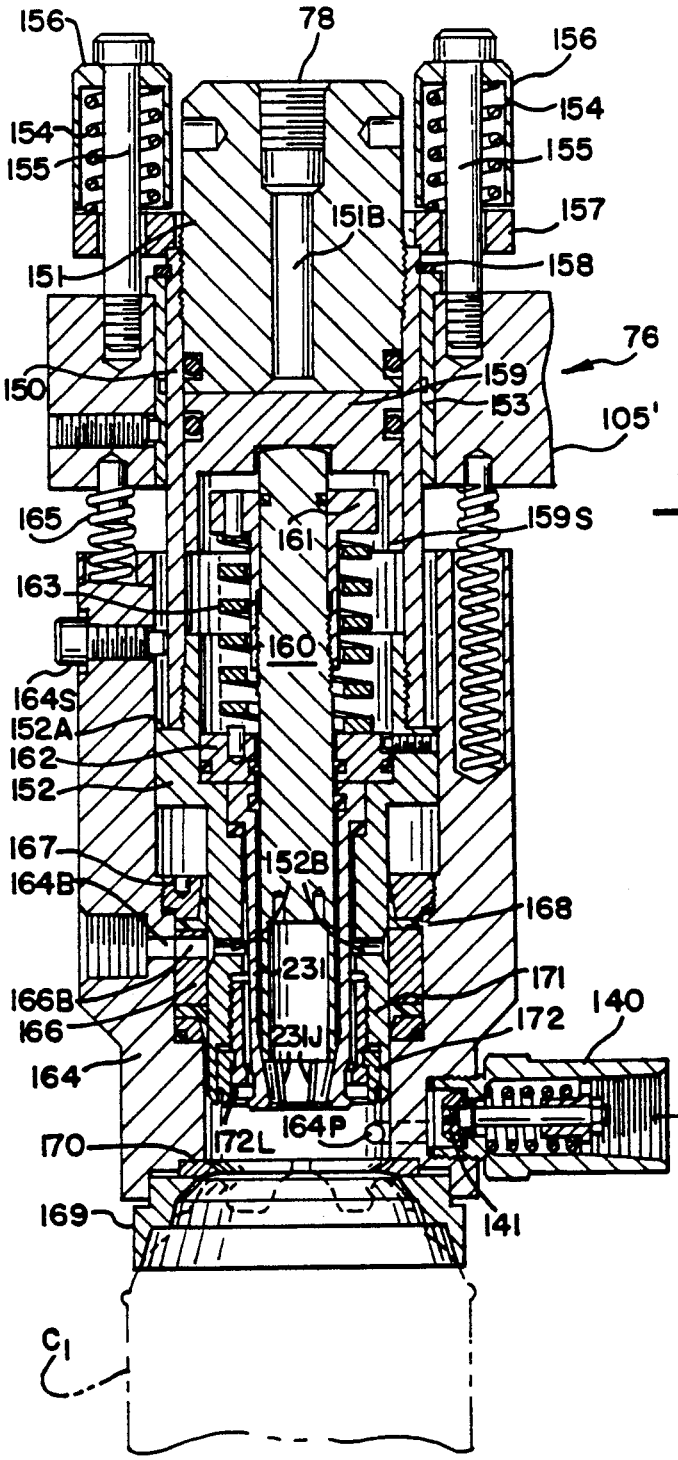
Figure 2A:
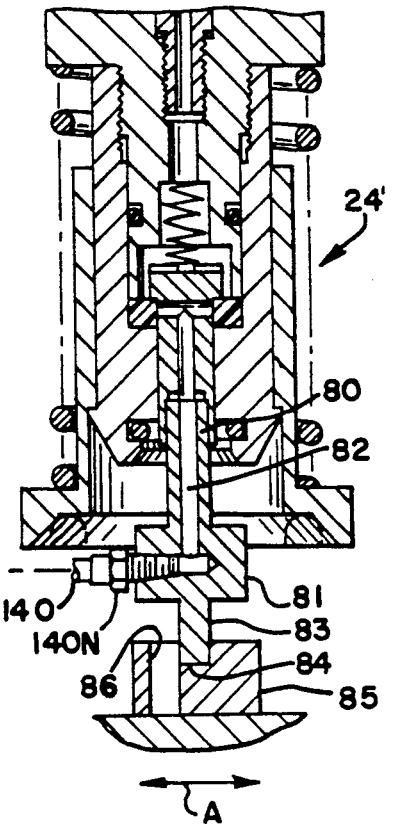

For a more complete understanding of the nature and scope of the present invention, reference may be had to the following detailed description of preferred embodiments taken in conjunction with the accompanying drawings, wherein:

FIG. 1 is a elevational view partly in vertical section and partly schematic of an apparatus for introducing gaseous propellants by the "through-the-valve" method into a aerosol container; and FIG. 2 and FIG. 2*a* comprise a composite view in vertical section of a modification showing apparatus for introducing gaseous propellant in accordance with the present invention by the "under-the-cap" method into an aerosol container.

Referring to FIG. 1, there is indicated generally at 20 a pressure filler head or dispenser unit corresponding to the pressure filler head or dispenser unit 20 shown and described in connection with FIG. 1 of Stanley et al. U.S. Pat. No. 3,013,591 dated Dec. 19, 1961 assigned to the assignee of the present invention and application, the disclosure of which is incorporated by reference herein.

The head 20 is mounted on a vertically reciprocable operating post 21 by means of an aluminum bracket 22 encircling and fixed to the head by a lock screw 20S and encircling and fixed to the post by cap screws 21S acting against a key 23 engaged internally between the post and bracket.

The filler head includes a container-engaging adapter, designated generally as 24, arranged to mate with the top of the container C. In the present arrangement, the adapter provides a positive shut-off for preventing propellent flow from the head 20 in the absence of engagement with a container at the fill position. The interaction of the adapter against the container C and its valve triggers the pressure discharge of a predetermined or metered quantity of gaseous propellant from the filler head and the construction of the adapter 24 is such that it first conditions the filler head for its metered discharge and thereafter completes a supply path through the discharge passage and container valve from the head to the container.

The pressure filler head has a tubular main housing or casing 26, the opposite ends of which are provided with screw-threaded end closure plugs 27 and 28, respectively, each of which has an axial passage. A cylinder sleeve 29 is disposed within the housing in annularly spaced relation thereto and is provided with a set of wall openings 29A adjacent each of its opposite ends for establishing communication between the annular space 30 between the housing and cylinder sleeve and the opposite ends of the cylinder. The housing is provided with a nipple 26N for convenient attachment with a supply hose (not shown) extending from a source of gaseous propellant maintained at a constant pressure and a constant temperature depending upon the particular propellant. Each end plug has an enlarged elevated central surface 27S and 28S for shouldered marginal engagement within the adjacent end of the cylinder sleeve 29 to position and maintain the sleeve coaxially within the housing.

A piston 31 of any suitable construction is mounted for liquid-tight, sliding movement within the cylinder and, as illustrated, may be shaped to provide an annular space for receiving V-type packing rings 32 which encircle the piston and are held under suitable compression by a ring cap 33. An externally threaded coupling element 34 is fixed in and projects from the upper end of the piston to receive a lock nut 33N for fixing the ring cap 33 in position. The coupling element serves to anchor a piston rod 35 which projects in liquid-tight slideable relation through a seal ring packing 36 providing in the axial passage of the upper end closure plug 27.

The upper plug includes an internally threaded integral end collar 27C which mounts a stainless steel guide tube 37 slotted intermediately along its length as indicated at 37S. The piston rod 35 is movable lengthwise within the tube and engages with a carrier 38 confined with the upper end of the guide tube by a lock screw 39. A stop pin 40 rides in the carrier and projects transversely through the slots in the guide tube for locating engagement with a stop collar provided on the guide tube in the form of a pair of jamb nuts 41 which encircle and threadingly engage the guide tube. Abutment of the stop pin against the jamb nuts determines the upper limit of piston travel, and the jamb nuts are adjustable along the guide tube to vary the total piston travel that is permitted. The space 43 in the cylinder sleeve beneath the lower face of the piston constitutes a metering chamber the capacity of which is regulated within limits by adjustment of the jamb nuts 41 along the guide tube 37. The lower end of the metering chamber is closed by a disc-shaped end casting 44 having an axial discharge opening for metering chamber and formed with a depending tubular support wall 44T having radial openings 44A to establish a propellant path from the cylinder sleeve openings to the discharge opening of the metering chamber. An annular valve seat 44S is formed on the underface of the disc in surrounding relation to the discharge opening thereof. A movable valve 45 has a lengthwise bore extending through its enlarged head 45H and its depending stem 45S to form a discharge passage for the metering chamber.

The movable valve 45 is mounted with its enlarged head 45H disposed for axial movement within the tubular depending wall of the end casting 44 and with its depending valve stem 45S extending in liquid-tight slideable relation through a seal ring packing 46 provided in the axial passage of the lower end closure plug 28. A flat rubber ring gasket 47 is mounted on the enlarged head of the movable valve for sealing engagement with the valve seat 44S on the end casting. The head end of the movable valve is provided with a valve seat 45V that is engageable with a polytetrafluoroethylene valve seat ring 48 carried in countersunk relation within the lower end of the piston 31. When the piston 31 is at the lower end of its stroke, the seat 48 seals against the valve seat 45V on the movable valve to block the discharge passage extending through the movable valve.

The adapter 24 has a two-piece body comprised of interfitting upper and lower elements 50 and 51, respectively, which are fixedly engaged in screw-threaded relation. Lengthwise passages 50P and 51P extend centrally through the body elements 50 and 51 to complete the discharge passage through the movable valve. The upper section of the passage in the lower element is enlarged to receive the reduced lower end of the upper element for connecting the passages of these elements in series. The depending stem of the movable valve 45 is fixed in the top of the adapter body element 50 in open communication with the passage 50P thereof. The lower body element 51 is formed with an upwardly facing marginal external shoulder around its lower end cooperating with an internal marginal shoulder provided on a container locating sleeve 52 which is mounted in slideable telescoping relation around the lower element 51. The locating sleeve is biased downwardly by an external coil spring 53 reacting between the upper element 50 and a marginal end flange 52F on the locating sleeve. A poppet valve 54 cooperates with a seal ring 56 fixed internally between the adapter body elements 50 and 51, in a position to encircle and seal the poppet valve 54. The parts are illustrated in their normal position, and it will be clear that the discharge passage through the adapter is closed by the seal existing between the poppet valve 54 and seal ring 56. The lower end of the poppet valve is provided with a socket 54S shaped to receive the container valve V, while the lower end of the locating sleeve 52 is shaped to receive the top of the container C and lower end of adapter body element 51 is formed with an internal annular mounting recess for a seal ring 57 that engages and seals against the container closure.

As mentioned previously, one function of the adapter 24 is to normally block discharge from the filler head, such blocking being controlled by the poppet valve 54 in the discharge passage of the adapter. The large external coil spring 53 is selected to offer a high resistance to closure, the stiffness of this spring being sufficient to resist movement of the locating sleeve 52 upwardly along the adapter body element 51 until the adapter body goes solid against the pressure head, this relationship being established when the joint upward movement of the locating sleeve 52 and adapter body 50, 51 carries the movable valve 45 against its seat 44S. An integral tubular depending guide collar 28C on the lower end closure plug 28 guides the adapter 24 in its vertical movement. The movable valve 45, through its sealing contact with the seat 44S, traps the charge of propellant in the metering chamber 43 and isolates the source of propellant from the discharge passage 50P, 51P.

The container rim, by its engagement against the locating sleeve 52, forces this sleeve upwardly along the adapter body element 51, permitting the container neck to enter into sealing engagement with the O-ring 57 and permitting the container valve V to lift the poppet valve 54 upwardly and unblock the discharge passage.

An important feature of the arrangement of the adapter unit resides in the fact that it first interrupts the supply of propellant from its source to the discharge passage 50P, 51P and thereafter unseats the poppet valve 54 to open the discharge passage. The arrangement is also such that the O-ring 57 housed within the lower end of the adapter body element 51 establishes sealing engagement around the neck of the container before the container valve completely unseats the poppet valve.

The full cycle of operation of the filler head 20 may now be readily understood. In FIG. 1, the parts of the adapter 24 are shown in the normal position which they assume prior to engagement with the container C. In this position, the movable valve 45 is down and both ends of the cylinder 29 are in communication with the propellant source through supply passages which include the nipple 26N, the annular space 30 between the cylinder and housing, and the wall openings 29A at opposite ends of the cylinder. Thus, the pressure of the propellant acts on opposite faces of the piston 31 and due to the differential areas resulting from the externally projecting piston rod 35, the force on the underneath face of the piston predominates and the piston is forced to its uppermost limit of travel as determined by engagement of the stop pin 40 with the jamb nuts 41. In moving the piston upwardly, the liquid propellant progressively fills the metering chamber 43.

With a container C in position beneath the filler head 20, the post 21 lowers the filler head downwardly to engage the adapter 24 around the top of the container and lift the movable valve 45 against its seat 44S for isolating the charge of propellant within the metering chamber 43. Continued downward movement of the post 21 then causes the container valve V to open the poppet valve 54 and unblock the discharge passage for allowing propellant to flow from the metering chamber through the movable valve 45 and adapter 24 to enter the container through its valve. As the liquid in the metering chamber begins to flow from under the piston 31, there is a reduction in pressure in the metering chamber resulting in the constant pressure on the top of the piston predominating and forcing the piston down until the metering chamber is empty. At the lower end of the piston's stroke, the valve seat 48 on the piston engages the seat 45V on the movable valve to seal off the discharge passage until the filler head moves out of engagement with the container. When the operating post rises and carries the pressure head upwardly, the poppet valve 54 drops down to block off the discharge passage and then the movable valve 45 drops down to restore communication of the pressurized propellant to the metering chamber at the lower side of the piston. The differential areas on the piston faces again establish a resultant force for moving the piston upwardly and trapping another metered charge of propellant in the metering chamber for discharge into the next container during the next filing cycle.

It will be seen that by maintaining the temperature and pressure on the propellant in the supply, and by withdrawing a predetermined volume of the gaseous propellant from the supply on each cycle of operation of the pressure head 20 that an equal weight or mass of the propellant will be introduced into each container C regardless of the speed of operation of the pressure filler head 20.

As stated above, the introduction of the gaseous propellant into the liquid product within a container C can be greatly enhanced by subjecting the container C to ultrasonic agitation during the introduction of the propellant. A suitable apparatus for the application of ultrasonic agitation is shown in FIG. 1 with the container C resting directly on the top of the ultrasonic horn 60. The upper end of the horn 60 projects through an opening 61 provided in a table 62 with the upper end surface of the horn being generally flush with the top surface of the table 62.

At its lower end, the horn 60 is connected with the upper end of the booster unit 63 supported on a support 64. The booster 63 is connected at the bottom end with a piezoelectric converter 65 connected by means of a vapor-tight cable 66 to the power supply as indicated.

The ultrasonic horn 60, booster 63 and converter 65 may be of known commercially available type as follows:

Branson 187 P 1500 watt power supply with Branson 803 Ultrasonic converter (Piezoelectric).

The apparatus shown and described in connection with FIG. 1 is suitable for introducing propellants in amounts ranging from 50 cc to 550 cc into an aerosol container C containing from 2 to 20 ounces of a difficult-to-saturate aqueous product. The size of the supply of propellant can vary widely but preferably should be substantially greater than the size of each charge of propellant which is withdrawn during each cycle of operation of the pressure filler head 20. When the propellant is carbon dioxide it has been found that a supply temperature of 70° F. and a supply pressure of 350 pounds per square inch gauge provide suitable temperature/pressure conditions. Likewise, when the propellant is nitrous oxide, the supply temperature may typically be 70° F. with a supply pressure 350 pounds per square inch gauge.

The suitable range of ultrasonic agitation or frequency may be within an ultrasound frequency of 20 to 100 kilocycles. By way of illustration, it has been found that with a container C containing 12 ounces of 70% isopropyl alcohol agitated at a frequency of 20 kilocycles, a propellant charge of 7 grams of $CO_2$ can be introduced through the valve V by the pressure filler head 20 in a time of 1.5 seconds with thorough and uniform saturation of the propellant in the product being obtained. Under these conditions, through-the-valve filling can be carried out at production operating speeds of between 15 to 30 containers per minute per head.

As stated above, the present invention is also useful in connection with the "under-the-cap" apparatus and methods of gassing or introducing gaseous propellant into aerosol containers with various liquid products in them. In FIG. *2a* an adapter head portion 24' of a filler head corresponding to the adapter portion 24 of the filler head 20 of FIG. 1 is shown in association with an under-the-cap crimper head indicated generally at 76. The crimper head 76 corresponds to the crimper head shown and described in connection with FIGS. 21–26 of Stanley et al. U.S. Pat. No. 3,157,974 dated Nov. 24, 1964 assigned to the assignee of the present application and invention and the disclosure of which is incorporated by reference herein.

The crimper head 76 has a main cylinder sleeve 150 threaded internally at its opposite ends to receive an upper cylinder end casting 151 and a lower cylinder sleeve extension 152. The main cylinder sleeve is disposed in the mounting bracket 105' with a suitable bushing 153 provided between the sleeve and bracket to accommodate sliding movement of the cylinder sleeve through the bracket for developing a preloading force through a set of four springs 154 which telescope over a set of upstanding guide posts 155 that are fixed in the mounting bracket. The preload springs 154 are housed in retainer shells 156 that abut against the upper end of the guide posts and seat against a common preload ring 157 that abuts against the upper end of the main cylinder sleeve. A lock ring 158 holds the cylinder from falling out of the mounting bracket.

A free sliding piston 159 is disposed within the main cylinder sleeve 150 for actuation by hydraulic liquid pressure delivered to port 78 that is connected through a central lengthwise bore 151B in the cylinder end. The piston has an integral depending skirt 159S about its outer margin forming a guide pocket for a plunger assembly which is slidable axially through the head in response to the application of hydraulic pressure thereto.

The plunger assembly includes a main plunger element 160, a headed thrust sleeve 161 threaded on the exterior of the plunger element to encircle the upper end thereof, a carrier ring 162 seated in sealing relation within an annular pocket at the upper end of the sleeve extension 152, a plunger return spring 163 encircling the plunger and reacting between the thrust sleeve 161 and the carrier ring 162. The segmented collet 231 is confined within the sleeve extension and is disposed in encircling relation to the lower end of the plunger element 160. The jaws 231 of the collet are engageable about the I.D. of the closure cap (not shown) for the container $C_1$, and upon downward movement of the plunger 160 are spread outwardly to crimp the closure cap into sealed relation about the mouth of the container.

A container locating bell 164 is mounted for sliding movement about the exterior of the main cylinder sleeve 150 and the sleeve extension 152 and is fitted with a set of stop screws 164S adjacent its upper end that are engageable with an annular exterior abutment shoulder 152A at the upper end of the sleeve extension 152 for holding the bell in position on the crimper head. A set of coil springs 165 are seated in spring pockets opening through the upper end of the bell and react against the mounting bracket to normally urge the bell downwardly relative to the main cylinder sleeve. Thus when the head unit is freely suspended, the lower end of the bell hangs substantially beneath the collet with the bell being yieldably maintained in this position by engagement of the stop screws 164S against the abutment shoulder 152A of the sleeve extension. In FIG. 2 the head unit has been lowered on the container and is in position for applying vacuum to the container during the vacuum cycle. In the freely suspended position the bell 164 would drop down from the position shown in FIG. 2 until stop screws 164S rest on the shoulder 152A, while the support bracket 105', the main sleeve 150 and the sleeve extension 152 and associated mechanisms remain at the same elevation.

The bell 164 has an annual internal pocket intermediately of its length fitted with an axial assemblage of annular seal ring elements that seat against a central shell of annulus 166 which has a radial bore 166B fixed in registry with a radial bore 164B in the bell to form a passage for the vacuum line. A cap ring 167 is threaded into the bell to compress the seal rings 168 of the assemblage. This vacuum passage through the bell 164 and shell 166 is adapted to open into a series of radial ports or bores 152B provided in the extension sleeve to establish communication with the lower end of the head through annular clearance spaces that exist between the collet 231 and the extension sleeve 152.

The bell has another internal bore 164P adjacent its lower end forming an entrance passage for the propellant transmission line 140 extending from the outlet nipple 140N on the adapter 24. The bore 164P opens into the head in a generally tangential direction to deliver propellant with tangential swirling motion.

At its lower end, the bell is fitted with an internally contoured engaging adapter ring 169 which is threaded within the bell to mount an internal seal ring gasket 170 that establishes sealing engagement about the upper end of the container for confining the applied suction and/or the delivered propellant to the container. A stop sleeve 171 is threaded within the lower end of the extension sleeve element 152 and a seal ring 172 is mounted between the lower ends of the extension sleeve element 152 and the stop sleeve 171. The stop sleeve 171 is adapted to seat against the top of the closure cap rim and the seal ring 172 is adapted to engage about the outer periphery of the closure cap rim to block propellant against entry into the collet and piston region of the crimper head.

At the beginning of a cycle, the operating piston 159 of the crimper head is at its upper limit of travel and the bell 164 is suspended with its stop screws 164S in engagement with the abutment shoulder 152A on the exterior of the extension sleeve element. As a container moves into its mounting niche beneath the bell 164 of the crimper, the operating post (not shown) connected to mounting bracket 105 simultaneously begins to move downwardly to immediately seat the adapter ring 169 upon the container. This makes full use of the time available in each cycle. With the bell suspended in its initial lowermost position, the vacuum passages 164B and 166B through the bell are sealed at a point on the extension sleeve element 152 that is located slightly below the port 152B provided in the sleeve extension by the seals 168.

An important feature of this arrangement resides in the fact that the vacuum passage remains closed if no container is presented for engagement by the bell. In the absence of a container, the bell and the entire crimper head mechanism move downwardly in unison with the bell in its freely suspended lowermost position where the port 166B is located below the ports 152B so that the vacuum port remains closed. It is important that the absence of a container will not result in dissipating the suction effect of the vacuum source as this would impair the processing of the other containers.

As the crimper head is brought down upon a properly positioned container, the hold down springs 165 in the bell are compressed to bias the bell against the container for loading the seal ring 170 sufficiently to create a leakproof seal about the upper end of the container.

Continued downward movement of the operating post moves the main cylinder sleeve 150 downwardly through the bell until the vacuum port 152B in the sleeve extension is in registry with the vacuum passage 164B in the bell as shown in FIG. 2. This subjects the region at the top of the container to the vacuum for first elevating the cap and for thereafter vacuum purging air or other gaseous material in the container. At this stage, the cap of the container is not stripped onto the collet 231 to an extent sufficient to create a seal against the rubber seal ring 172 and this is important for maintaining the vacuum passage which extends upwardly between the collet 23 and the stop sleeve 171.

After dwelling at this "vacuum" level for a time sufficient to complete vacuum purging of the container, the machine operating post again moves downwardly to forceably strip the collet 231 into the cap preparatory to mechanically lifting the cap above the container.

When the post is at its lower limit of travel, the cap will be fully stripped on the collet and the O.D. of the cap rim has sealing engagement with the seal ring 172 which moves in unison with the collet at this stage of the cycle.

The operating post is then raised a short distance to elevate the cap above the container and provide desired clearance beneath the cap for filling the propellant through its tangentially directed inlet port 164P and into the container. The tangent inlet port 164P at the terminus of the propellant entry passage develops a tangential swirl of propellant for avoiding turbulence in the entering stream of propellant and for avoiding impact charging of the propellant such as might lead to splashing of the product and contamination of the inside of the head and also of the exterior of the top of the container. During this pressure fill phase of the cycle, the seal between the seal ring element 172 and the rim of the closure cap blocks propellant against escape into the vacuum passages and the seal ring element has a pressure responsive self-sealing circumferential lip configuration 172L that increases in sealing effect in direct proportion to the pressure exerted upon it by the propellant.

A pressure filler head 20 (FIG. 1) with its adapter 24 operates to supply propellant under pressure through the transmission line 140 and its check valve 141 and into the crimper head 76 during the interval when the crimper head completes the delivery passage by unblocking the tangential inlet port 164P in the lower end of the bell. After the pressure filling step is completed, the operating post for the crimper head is again lowered to drive the collet down and seat the cap in the mouth of the container.

Simultaneously, the stop sleeve 171 seats on the rim of the cap for applying a preload force from the preload springs 154 at the upper end of the head mounting bracket 105. The preload force is transmitted from the preload springs 154 through the spring seat thrust ring 157, through the main cylinder sleeve element 152 and the stop sleeve 171. The preload force is developed by virtue of the over-travel motion of the mounting bracket 105 with respect to the main cylinder sleeve 150. This over-travel sets up the preloading compression of the springs.

The preload force upon the closure cap develops an initial flow of the usual flowed-in-gasket utilized at the underface of the closure cap rim for establishing a seal with the container. Practical experience has shown that these flowed-in-gaskets must be preloaded prior to the actual crimping of the cap if they are to affect a good seal. Preloading is less important where the product within the container is capable of causing swelling of the flowed-in-gasket but it is more important where only a material is present which is incapable of inducing this swelling action which is so important for insuring the development of a good seal.

When the cap is properly seated in the container mouth under a preload force applied by the springs 154, the operating post dwells for a period during which hydraulic pressure is applied through the cylinder end 151 to the backface of the piston 159 to drive the piston downwardly and correspondingly to force the plunger 160 through the lower end of the collet 231 for spreading the collet jaws into crimping engagement with the cap rim. This travel of the piston 159 and plunger 160 is resisted by the plunger return spring 163 which becomes compressed to store up sufficient energy for returning the plunger. The hydraulic pressure in port 78 is then removed and the return spring 163 expands to restore the plunger 160 to its initial position at the upper end of the main cylinder sleeve 150.

As soon as the operating post starts upward, the bell springs 165 urge the bell 164 downwardly relative to the other parts of the crimper head to exert a force tending to strip the container free of the collet 231. After a short rise, sufficient to establish the vacuum passages 164B and 166B in registry with the vacuum port 152B the operating post dwells briefly. During this dwell period, the seal ring 170 within the locating adapter ring 169 maintains its seal against the container wall to enable the vacuum line to evacuate any gas or other volatile fluids remaining in the region surrounding the top of the container or in the tangential propellant entry passage.

Finally, the operating post returns to its initial position at the full upper limit of travel to lift the bell and its adapter free of the container for permitting discharge of the container.

It will be understood that the adapter 24' and the pressure filler head with which it is associated operates in timed relationship with the crimper head 76. Thus, a pressure filter head corresponding to the pressure filler head 20 and which incorporates the adapter 24' will have taken in a metered quantity of gaseous propellant from the supply maintained at constant predetermined temperature and pressure and will be ready to discharge that metered amount into line 140 when the propellant inlet port 140P is opened for receiving the propellant.

Since the metered quantity of propellant will not be discharged by the adapter 24' directly into the inlet valve on a aerosol container, a nipple 80 is mounted on the adapter 24' which takes the place of the inlet valve on a container. The nipple 80 is integrally formed with a block member 81 having a vertical passageway 82 which communicates with the transverse or lateral passageway into which the nipple 140N is screwed. A stem 83 depends from the bottom of the block member 81 for actuating engagement with a step 84 on a rigidly supported block 85. The block 85 also has a vertical clearance recess 86 and is shiftable as indicated by the arrow A between the normal position in which it is shown in FIG. 2 and an alternative position where it is shifted to the right so that the stem 83 projects into the clearance opening 86. As disclosed in above-mentioned U.S. Pat. No. 3,157,974, a suitable mechanism of known type is provided so that in the event a container is not presented underneath the crimper head 76 when called for, the block 85 will shift to the right so that on the downward stroke of the adapter 24', the stem 83 will not engage the step 84 and the poppet valve 54 will not be unseated.

It will be understood that each container that receives a charge of propellant through its mouth and underneath its raised cap by operation of the crimper 76 is ultrasonically agitated by apparatus corresponding to that shown and described in FIG. 1 for ultrasonically agitating the container C.

What is claimed is:

1. The method of rapidly introducing predetermined quantities of propellant in the gaseous state into aerosol containers containing predetermined quantities of product to be dispensed by propellant pressure in spray or aerosol form, which comprises, maintaining a supply of propellant in the gaseous state at substantially uniform predetermined temperature and pressure, withdrawing predetermined isolated volumes of said propellant from said supply, rapidly introducing each said predetermined isolated volume of propellant into each said product-containing container while agitating each said container and its contents of product and propellant by applying ultrasonic energy to each said container.

2. The method of claim 1 wherein the volume of said maintained supply of said propellant is many times greater than each said withdrawn volume.

3. The volume of claim 1 wherein said ultrasonic energy is applied to each said container by direct engagement with an energized ultrasonic horn.

4. The method of claim 1 wherein said containers have dispensing valves and said propellant is introduced through said valves.

5. The method of claim 1 wherein closure caps with attached dispensing valves are lifted from openings in the containers while said propellant is introduced and thereafter said closure caps are crimp sealed to said container openings.

6. Apparatus for rapidly introducing predetermined quantities of propellant in the gaseous state into aerosol containers containing predetermined quantities of product to be dispensed by propellant pressure therefrom, comprising in combination, means for maintaining a supply of said gaseous propellant at substantially uniform predetermined pressure and temperature, means connected to said supply for withdrawing predetermined isolated volumes of propellant from said supply for discharging each said withdrawn volume of propellant into a said aerosol container, and means for ultrasonically agitating each said aerosol container as a said predetermined volume of propellant is discharged thereinto.

7. The apparatus called for in claim 6, wherein said means for withdrawing and discharging said predetermined volumes of propellant comprises a pressure filler head comprising a dispenser interengageable with said aerosol containers and having a chamber of predetermined volume for receiving thereinto each said predetermined volume of propellant as it is withdrawn from said supply of propellant and having a normally closed propellant discharge passage, means for connecting said supply of propellant in continuous communication with said dispenser operable when said dispenser is out of engagement with a said aerosol container for supplying said propellant to said dispenser to establish a said predetermined volume of propellant in said chamber, and means responsive to actuating engagement with a said aerosol container for isolating said chamber and said predetermined volume of propellant therein from said supply of propellant and for opening said discharge passage into said engaged aerosol container to discharge said isolated predetermined volume of propellant thereinto.

8. The apparatus called for in claim 6, wherein said means for withdrawing and discharging said predetermined volumes of propellant comprises, a pressure filler head comprising a dispenser and having a chamber of predetermined volume for receiving thereinto each said predetermined volume of propellant as it is withdrawn from said supply of propellant and having a normally closed propellant discharge passage, means for connecting said supply of propellant in continuous communication with said dispenser operable when said dispenser is out of engagement with actuating means for supplying said propellant to said dispenser to establish a said predetermined volume of propellant in said chamber, and means responsive to said actuating means for isolating said chamber and said predetermined volume of propellant therein from said supply of propellant and for opening said discharge passage to discharge said isolated predetermined volume of propellant from said chamber, and a crimper head comprising first means for engaging and producing a seal around the top opening of an aerosol container having its closure cap loosely positioned thereover, second means for drawing a vacuum in said container, conduit means connecting a propellant inlet port in said crimper head with said discharge passage of said pressure filler head whereby as said predetermined and isolated volume of propellant is discharged from said pressure filler head it is delivered through said inlet port and into the aerosol container engaged by said first means, and third means in said head for engaging said closure cap to seat it onto said opening and crimping it to said container after said predetermined volume of propellant has been delivered thereinto.

* * * * *